United States Patent [19]

Foldes

[11] 4,148,030

[45] Apr. 3, 1979

[54] HELICAL ANTENNAS

[75] Inventor: Peter Foldes, Wayne, Pa.

[73] Assignee: RCA Corporation, New York, N.Y.

[21] Appl. No.: 806,283

[22] Filed: Jun. 13, 1977

[51] Int. Cl.[2] ..... H01Q 1/36
[52] U.S. Cl. ..... 343/895
[58] Field of Search ..... 343/846, 895

[56] References Cited

U.S. PATENT DOCUMENTS

| | | | |
|---|---|---|---|
| 2,503,010 | 4/1950 | Tiley | 343/895 |
| 2,633,532 | 3/1953 | Sichak | 343/895 |
| 3,503,075 | 3/1970 | Gerst | 343/895 |
| 3,573,840 | 4/1971 | Draveil et al. | 343/895 |
| 3,906,509 | 9/1975 | Duhamel | 343/895 |

FOREIGN PATENT DOCUMENTS

| | | | |
|---|---|---|---|
| 1183143 | 1/1962 | Fed. Rep. of Germany | 343/895 |
| 1132607 | 7/1962 | Fed. Rep. of Germany | 343/895 |

*Primary Examiner*—Eli Lieberman
*Attorney, Agent, or Firm*—H. Christoffersen; Joseph D. Lazar

[57] ABSTRACT

A plurality of coaxially wound, untuned helical antennas have a pitch that is a function of displacement along the axis of the antennas. The untuned antennas may be excited by signals that have a selected phase shift therebetween. The excitation causes an additive combining of electromagnetic waves radiated by the untuned antennas. The helical antennas may be tuned to radiate the waves in respective bands of frequencies, thereby simultaneously providing filtering and radiation characteristics that make the tuned antennas suitable for frequency diplexing.

3 Claims, 11 Drawing Figures

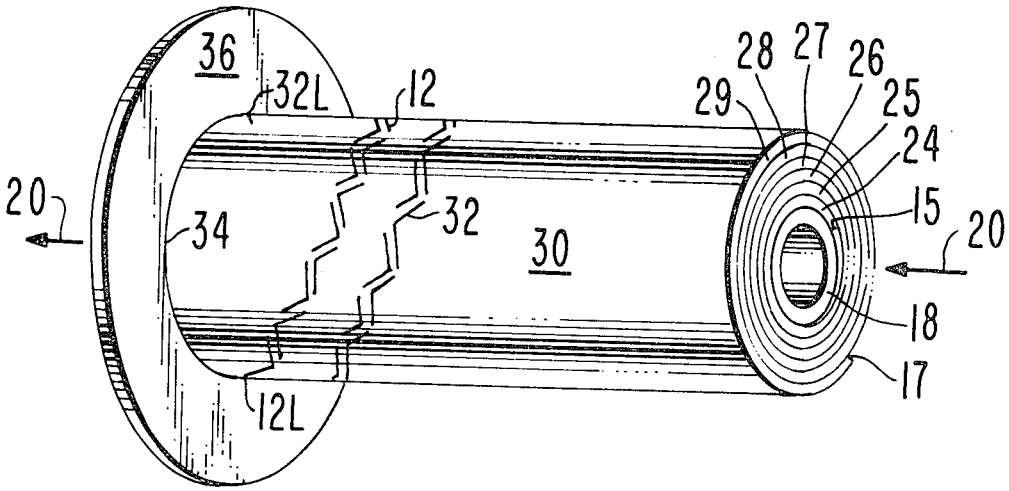

HELICAL ANTENNAS

FIELD OF INVENTION

This invention relates to antennas and more particularly to helical antennas.

DESCRIPTION OF THE PRIOR ART

One aspect of the operation of a helical antenna is the directivity of the antenna. The antenna either radiates electromagnetic waves to its surrounding medium or receives the waves therefrom with an angular directivity that may be represented by what is known as a far field pattern.

The antenna operates in an axial radiation mode when it has a far field pattern with a main lobe representative of a main beam that is directed coaxially with the axis of the antenna. The operation in the axial mode occurs when the antenna guides the wave along the axis with a phase velocity equal to the phase velocity of the wave in the surrounding medium. It should be appreciated that the antenna may be made to operate in a broadside radiation mode.

Another aspect of the operation of the antenna is the polarization of a far field, associated with the wave, that propagates from the antenna. The polarization may be measured by a linear test probe, such as a dipole, that is disposed at a selected distance from the antenna in a plane orthogonal to the direction of the propagation. When the measured field is constant with a rotation of the probe, the far field is referred to as being "circularly polarized."

Usually, a maximum field and a minimum field are measured during the rotation of the probe. When the maximum is measured with the probe at a given orientation, the minimum is usually measured with the probe orthogonal to the given orientation. The ratio of the maximum to the minimum is called an "axial ratio." The axial ratio is an indication of the difference of the polarization of the far field from circular polarization.

Although the prior art is replete with helical antennas, usually the main beam is not axially symmetrical, the axial ratio deviates substantially from unity and the far field pattern has undesirably large side lobes. Additionally, the side lobes in one azimuthal plane are usually different from the side lobes in another azimuthal plane. Moreover, the main beam is usually not directed coaxially with the axis of the antenna.

In an antenna system of a communication satellite, for example, the antenna has to operate over a wide frequency range. Moreover, during the operation of the antenna, either a plurality of transmitters or a plurality of receivers are connected to the antenna. The outputs of the transmitters may be connected via a multiplexer network comprised of a plurality of filters. However, the multiplexer is bulky, heavy and lossy.

Alternatively, the transmitters may be respectively connected to a plurality of helical antennas that are in close proximity to each other. Although the plurality of antennas obviates the bulk, weight and losses of the multiplexer, the proximity of the antennas causes a coupling therebetween which results in loss of directivity of the antennas.

A maximization of directivity and a minimization of bulk, weight, and loss are critically important in the communication satellite. Therefore, it is desirable that the antenna system include decoupled helical antennas in close proximity to each other.

SUMMARY OF THE INVENTION

According to one aspect of the present invention, first and second coaxial helical antennas are comprised of resonating elements tuned to first and second frequency pass bands, respectively.

According to another aspect of the present invention, a composite antenna is comprised of a plurality of untuned coaxial helical antennas with a known angular displacement therebetween. Excitation of the antennas with respective signals that have a phase relationship corresponding to the angular displacement causes an additive combining of electromagnetic waves radiated by the antennas, whereby the transmitted power of the antennas is additively combined.

DESCRIPTION OF THE PREFERRED EMBODIMENT

Figure 1:
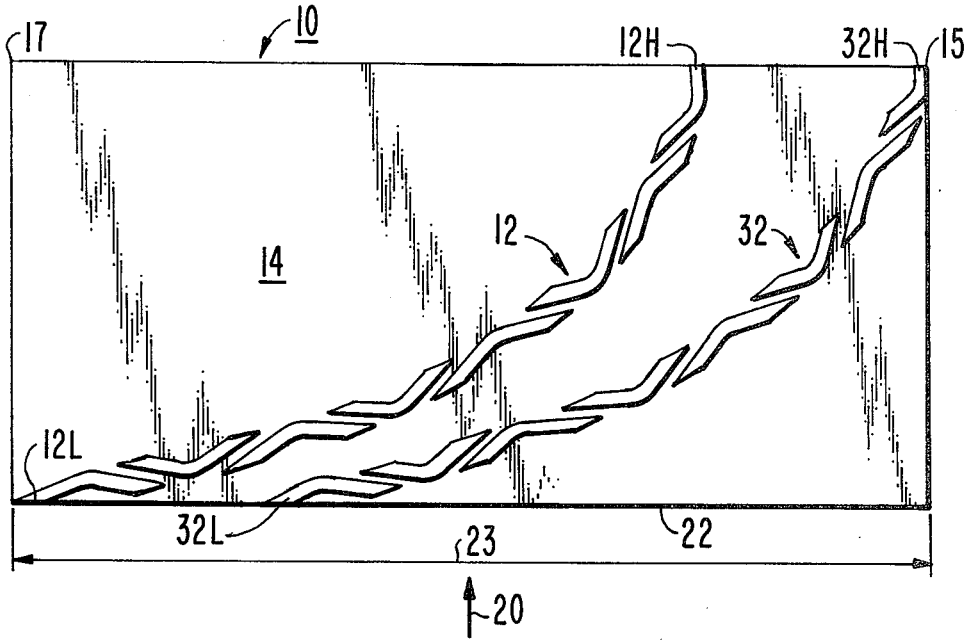
FIG. 1 is a plan view of a printed circuit assembly in accordance with a first form of the embodiment of the present invention.
Figure 2A:
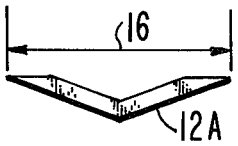
FIGS. 2A and 2B are plan views of dipoles in the assembly of FIG. 1.
Figure 2B:
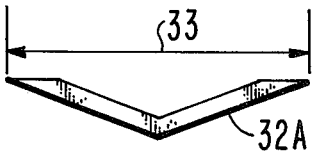
Figure 3:
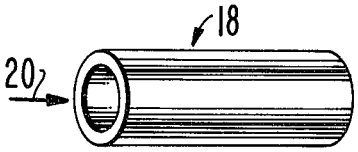
FIG. 3 is a perspective view of a hollow cylinder upon which the printed circuit of FIG. 1 is wound.

In a first form of the embodiment of the present invention, a plurality of tuned helical antennas are coaxially wound upon a hollow cylinder, whereby the antennas are colocated. When a helical antenna is tuned, it is suitable for either radiating or receiving an electromagnetic wave within a pass band of frequencies. Therefore, the plurality of tuned helical antennas may, for example, be used to provide frequency diplexing.

As shown in FIGS. 1–5, a printed circuit assembly 10 (FIG. 1) includes a helical antenna 12 made from a plurality of similar thin metal dipoles (12A, FIG. 2A) of the type that are used in a microwave strip line. The dipoles (12A) of antenna 12 are resonating elements that are coupled to each other in a manner similar to end-fire elements of a microstrip filter.

Antenna 12 is disposed upon a surface of a pliable, electrically insulating substrate 14 that has the shape of a rectangular sheet. Antenna 12 may be disposed by the use of any of the techniques well known in the printed circuit art or in any other suitable manner. The dipoles of antenna 12 define a portion of a first spiral of Archemides on substrate 14, whereby antenna 12 defines a helix when subassembly 10 is bent over a cylindrical surface suitably aligned with printed circuit 10. Because the dipoles of antenna 12 define the portion of the first spiral of Archemides, the pitch of the defined helix is a linear function of displacement along the axis of the defined helix. Accordingly, antenna 12 has a low pitch end 12L, where the pitch of antenna 12 is least, and a high pitch end 12H where the pitch of antenna 12 is greatest.

As known to those familiar with microstrip lines, antenna 12 has a first pass band that is determined by the length and the spacing between the dipoles of antenna 12. An exemplary dipole 12A (FIG. 2A) of antenna 12 has an end-to-end length 16 that is slightly longer than an ideal end-to-end dipole length of one half of a first wavelength associated with the center frequency of the first pass band. Length 16 is slightly longer than the ideal dipole length to compensate for mutual coupling and finite width of the dipoles of antenna 12.

In this form of the embodiment, printed circuit 10 is wound around a hollow cylinder 18 (FIG. 3) made from an insulating material. Moreover, the axis of cylinder 18 is in the direction of an arrow 20 (FIG. 1) that is perpendicular to an edge 22 of substrate 14.

Figure 4:
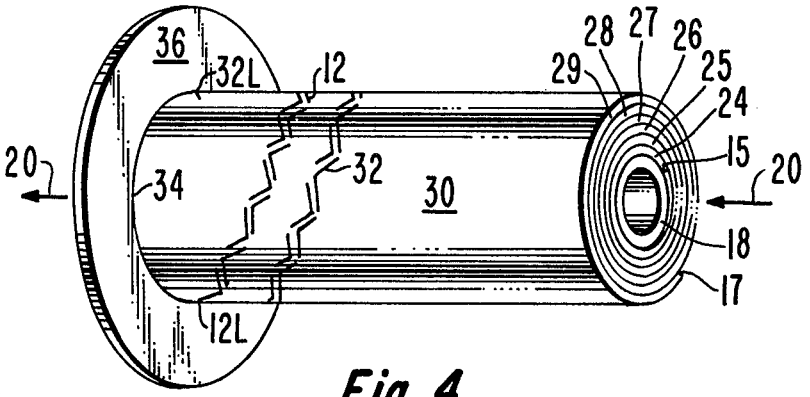
FIG. 4 is a perspective view of the first embodiment of the present invention.

FIG. 4 is an illustration of the first form of the embodiment wherein cylinder 18 has an outer circumference approximately equal to the first wavelength. Additionally, substrate 14 has a width 23 approximately equal to six circumferences of cylinder 18. Accordingly, when substrate 14 is wound around cylinder 18, layers 24–29 form an antenna assembly 30 wherein antenna 12 defines a first helix with six turns. Moreover, when subassembly 30 is formed, corners 15 and 17 of substrate 14 (FIG. 1) are on layers 24 and 29, respectively.

Printed circuit 10 (FIG. 1) additionally includes an antenna 32 made from thin metal dipoles that are disposed upon substrate 14 to define thereon a portion of a second spiral of Archemides. An exemplary dipole 32A (FIG. 2B) of antenna 32 has an end-to-end length 33 (analogous to length 16) that is slightly longer than an ideal end-to-end dipole length of one half of a second wavelength associated with the center frequency of the second pass band.

When substrate 14 is wound around cylinder 18 (FIG. 4), antenna 32 defines a second helix with six turns, where the pitch of the second helix is a linear function of displacement along the axis thereof. Accordingly, antenna 32 has a low pitch end 32L, where the pitch of antenna 32 is least, and a high pitch end 32H where the pitch of antenna 32 is greatest.

It should be understood that the distance from the outer circumference of cylinder 18 to layer 29 is less than one tenth of the outer circumference of cylinder 18 whereby the first and second helixes are of substantially constant diameter.

As known in the art, the gain of a helical antenna varies approximately as the square root of its axial length. It has been discovered that when the axial lengths of the first and second helixes are 3.04 times the first and second wavelengths, respectively and the diameter of cylinder 18 is approximately 0.33 times either the first or the second wavelengths, antennas 12 and 32 each have a gain of approximately 13.5 db.

It should be understood that because antenna 12 has the first pass band and antenna 32 has the second pass band, antennas 12 and 32 can either radiate or receive electromagnetic waves only within the first and second pass bands, respectively. Since antenna 12 can neither radiate nor receive the waves within the second pass band and antenna 32 can neither radiate nor receive the waves within the first pass band, antennas 12 and 32 are electromagnetically decoupled from each other.

Assembly 30 (FIG. 4) has an end 34 that abuts a grounded metal plate 36 which has the shape of a flat disc. Ends 12L and 32L are connected to respective coaxial feed lines (not shown) that pass through plate 36. A power transfer either to or from antennas 12 and 32 is provided via the feed lines. As well known to those skilled in the art, the transfer of power is maximum when antennas 12 and 32 provide an impedance match between the feed lines and free space. Typically, the feed lines and free space have impedances of 50 ohms and 377 ohms, respectively.

As known in the art, the impedance of a helical antenna determines the phase velocity of an electromagnetic wave that passes therethrough. Moreover, the impedance of the helical antenna is determined, in part, by the pitch of the helical antenna. Since antennas 12 and 32 have a pitch that is a linear function of axial displacement, when ends 12L and 32L are connected to the feed lines, antennas 12 and 32 have impedances of approximately 50 ohms proximal to the feed lines and approximately 377 ohms distal therefrom. In other words, antennas 12 and 32 are conceptually similar to transformers.

As known to those skilled in the art, in the absence of ground plate 36, antennas 12 and 32 have far field patterns with substantial side lobes due to radiation caused by currents on the outer conductor of the coaxial feed lines. In an alternative embodiment, ground plate 36 may have a curved surface that focuses the waves that are radiated by antennas 12 and 32.

Figure 5:
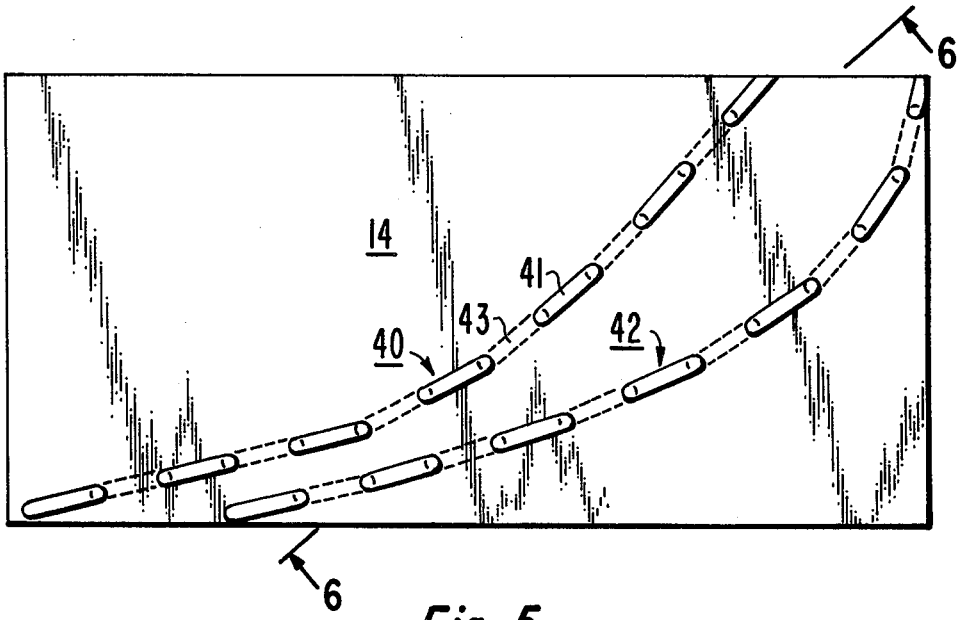
FIG. 5 is a plan view of an assembly which may be used as an alternative to the assembly of FIG. 1.
Figure 6:
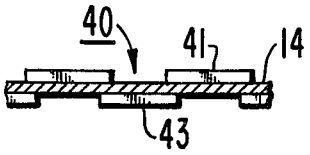
FIG. 6 is a fragmentary section of FIG. 5 taken along the line 6—6.

As shown in FIGS. 5 and 6, as an alternative to the dipoles (12A, 32A of FIGS. 2A and 2B), antennas 40 and 42 are comprised of thin rectangular metal strips (41, 43, etc.) with rounded ends. The strips are disposed lengthwise upon substrate 14 to define the portions of the spirals of Archemides described in connection with antennas 12 and 32. Moreover, the strips are disposed upon both surfaces of substrate 14 with the strips (41) on one surface partially overlapping the strips (43) on the other surface.

The lengths of the strips comprising antennas 40 and 42 are equal to one half of the first and second wavelengths, respectively. The length and spacing of the strips and the overlap cause antennas 40 and 42 to have the first and second pass bands, respectively.

It is well known that the electromagnetic wave has a phase velocity through a medium in proportion to the dielectric constant of the medium. As explained hereinafter, the dielectric constant of the medium is altered to provide an impedance match between a feed line and free space.

Figure 7:
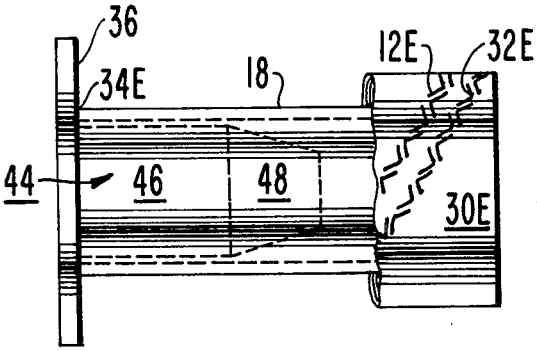
FIG. 7 is a side view, partly in section, of an antenna assembly wherein a dielectric rod is maintained.

As shown in FIG. 7, exemplary antennas 12E and 32E are included in an assembly 30E having an end 34E that abuts ground plate 36, assembly 30E being constructed in a manner similar to assembly 30 described hereinbefore. Moreover, assembly 30E is wound around cylinder 18 wherein a rod 44 is fixedly maintained near end 34E. Rod 44 may either be solid or hollow.

Rod 44 is formed of two portions; a cylindrical portion 46 that is made from a material that has a first dielectric constant and a tapered cylindrical portion 48 that has a second dielectric constant which is less than the first dielectric constant. One end of portion 46 is connected to the end of portion 48 that has the larger diameter. The first and second dielectric constants and the tapering of portion 48 causes the interior of cylinder 18 to have its highest dielectric constant near end 34E.

In this form of the embodiment, antennas 12E and 32E have the same pitch as antennas 12 and 32, respectively. For reasons explained hereinbefore, rod 44 causes the impedance match between a feed line and free space when the axial lengths of antennas 12E and 32E is less than the axial lengths of antennas 12 and 32.

Figure 8:
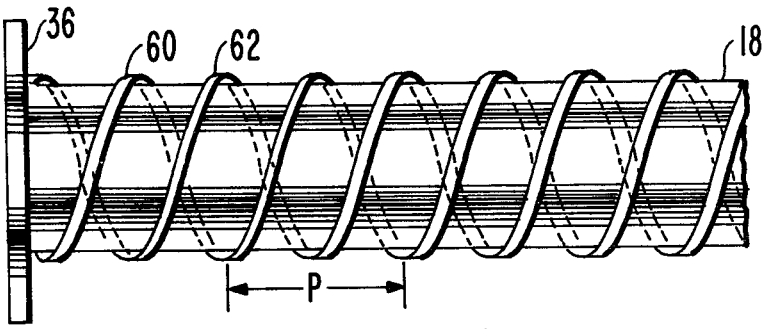
FIG. 8 is a side view of a second form of the embodiment of the present invention.

As shown in FIG. 8, a second form of the embodiment of the present invention includes a first helical antenna 60 and a second helical antenna 62 that are comprised of solid conductors. Therefore, antennas 60 and 62 are untuned. Antennas 60 and 62 are included in an assembly that has an end which abuts ground plate 36 in a manner similar to assembly 30 described hereinbefore.

Antennas 60 and 62 are coaxially wound around cylinder 18 with a 180 degree angular displacement therebetween. Antennas 60 and 62 may be disposed upon a pliable substrate, as described in connection with the first form of the embodiment (FIG. 4) or constructed in any other suitable manner.

The circumference of antennas 60 and 62 approximately equals a midband wavelength associated with a midfrequency of an operational range of frequencies at which antennas 60 and 62 either transmit or receive electromagnetic waves. Preferably, antennas 60 and 62 have a pitch (P) that is a linear function of axial displacement along antennas 60 and 62 for reasons given in connection with the first form of the embodiment.

Since the circumference of antennas 60 and 62 is approximately equal to the midband wavelength, there is an approximate phase change of 360 degrees in a signal that passes through one turn of either antenna 60 or antenna 62. Because of the 360 degrees phase change and the 180 degrees angular displacement, when antennas 60 and 62 are excited with first and second signals, respectively, that have a phase difference of 180 degrees, waves that are transmitted by antennas 60 and 62 are additive. Therefore, antennas 60 and 62 are a composite antenna that combines power from two sources which provide signals that have a phase difference of 180 degrees. Correspondingly, when a circularly polarized electromagnetic wave is received by antennas 60 and 62, feedlines connected thereto are provided to the signals that have the 180 degree phase difference.

In a similar manner, a composite antenna for combining power may be constructed from three or more coaxially wound helical antennas that have an angular displacement therebetween substantially defined by a relationship which is given as:

$$\theta = 360/N \qquad (1)$$

where $\theta$ is the angular displacement between the helical antennas; and

N equals the number of helical antennas.

Usually, current through a helical antenna is circumferentially asymmetrical because of standing waves along the antenna. The circumferential asymmetry is an indication that the antenna does not match its feed line to free space. It has been learned experimentally that the greater the number of helical antennas in a composite antenna, the more the current is circumferentially symmetrical. Moreover, by increasing the number of the helical antennas, the gain of the composite antenna is increased and the side lobe levels of the far field pattern of the composite antenna is reduced. However, little increase of the gain or reduction of side lobe levels is achieved by including more than four helical antennas in the composite antenna.

It should be understood that one alternative embodiment may include a plurality of tuned antennas, similar to antenna 12, that are coaxially wound with an angular separation in accordance with the displacement relationship (1). Another alternative embodiment may include coaxial first and second groups of tuned antennas, similar to antennas 12 and 32, respectively. The antennas of each of the groups are wound with the angular displacement in accordance with the relationship (1). The antennas of the alternative embodiments provide high gain, axial symmetry, an axial ratio that substantially equals unity and have far field patterns with low side lobe levels.

Figure 9:
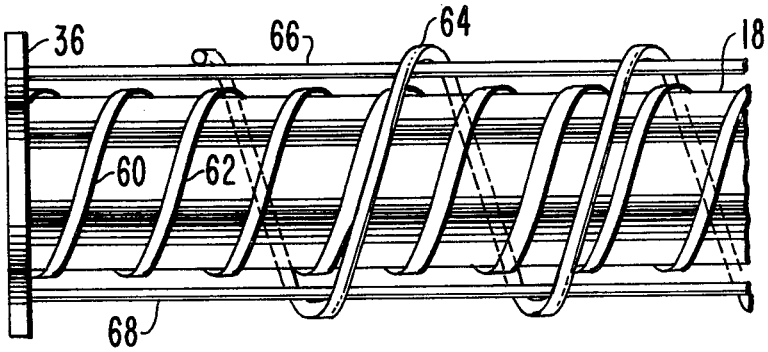
FIG. 9 is a side view of a helical winding used for side lobe suppression of antennas in the second form of the embodiment.

A modification of the composite antenna of FIG. 8 is shown in FIG. 9, wherein a helical conductor 64 is wound around antennas 60 and 62. Conductor 64 is supported by insulator rods 66 and 68 which are connected to ground plate 36. Additionally, conductor 64 is connected to ground in any suitable manner. Conductor 64 has approximately the same pitch and one half of the length of antennas 60 and 62. It has been demonstrated experimentally that conductor 64 may be positioned along the axis of cylinder 18 to cause the composite antenna to have reduced side lobe levels.

Figure 10:
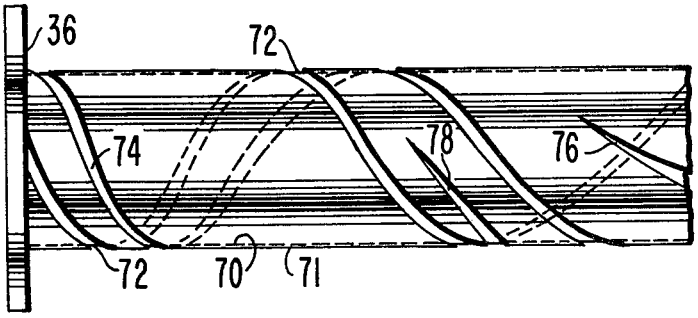
FIG. 10 is a side view of a third form of the embodiment of the present invention.

As shown in FIG. 10, in a third form of the embodiment, helical antennas, analogous to antennas 60 and 62 (FIG. 8) described hereinbefore, are comprised of a cylindrical insulator 70 that has a metal clad outer surface 71 which is etched to provide helical gaps 72 and 74. Insulator 70 is an assembly that has an end which abuts ground plate 36 in a manner similar to assembly 30 described hereinbefore. It should be appreciated that clad surface 71 provides a path for current with low ohmic loss because it covers most of the surface of insulator 70.

Preferably, gaps 72 and 74 have the tapered pitch referred to hereinbefore, whereby clad surface 71 defines a pair of helical antennas with the tapered pitch. The antennas defined by the clad surface may be connected to feed lines (not shown) as described hereinbefore. Because of the tapered pitch of gaps 72 and 74, the defined antennas match the impedance of the feed lines to free space.

The tapered pitch of gaps 72 and 74 cause the defined antennas to be relatively wide at the end thereof distal from the feed lines. Because of the large relative width, a longitudinal component of current may flow through the defined antennas in the direction of the axis thereof. The longitudinal component is undesirable because it does not cause a radiation of a circularly polarized electromagnetic wave. The longitudinal component of current is substantially eliminated by an inclusion of gaps 76 and 78 in the defined antennas near the ends thereof distal from the feed lines.

It should be understood that in an alternative embodiment, helical antennas may be provided where a turn of the helical antenna is acircular; elliptical, for example.

What is claimed is:

1. An antenna comprising:

a pliable, electrically insulating substrate in the form of a sheet;

a first group of coupled metal resonating elements deposited upon said sheet to define a first spiral, said elements resonating at frequencies within a first pass band;

a second group of coupled metal resonating elements fixedly disposed upon said sheet to define a second spiral, said elements resonating at frequencies within a second pass band; and a cylindrical insulator having one end that is adapted for connection to a surface of an electrically conductive ground plate, said sheet being wound on said cylindrical insulator to cause said first and second groups of resonating elements to define first and second helixes, respectively.

2. The antenna of claim 1, wherein said resonating elements comprise a plurality of dipoles.

3. The antenna of claim 1, wherein said resonating elements comprise a plurality of rectangular metal strips disposed upon both surfaces of said sheet with strips on one surface of said sheet overlapping strips on the other surface of said sheet.

* * * * *